US009885159B1

(12) United States Patent
Curtis

(10) Patent No.: US 9,885,159 B1
(45) Date of Patent: Feb. 6, 2018

(54) VEHICLE DEBRIS CLEARING DEVICE

(71) Applicant: Michael Lee Curtis, West Alexander, PA (US)

(72) Inventor: Michael Lee Curtis, West Alexander, PA (US)

( * ) Notice: Subject to any disclaimer, the term of this patent is extended or adjusted under 35 U.S.C. 154(b) by 0 days.

(21) Appl. No.: 15/397,794

(22) Filed: Jan. 4, 2017

Related U.S. Application Data

(60) Provisional application No. 62/278,289, filed on Jan. 13, 2016.

(51) Int. Cl.
*B62D 65/00* (2006.01)
*E01H 1/00* (2006.01)

(52) U.S. Cl.
CPC ..... *E01H 1/00* (2013.01); *B62D 65/00* (2013.01)

(58) Field of Classification Search
CPC ..... E01H 1/00; B62D 65/00
USPC ..... 293/115, 117, 118; 280/160; 37/235, 37/236; 172/3, 4
See application file for complete search history.

(56) References Cited

U.S. PATENT DOCUMENTS

| | | | | |
|---|---|---|---|---|
| 3,831,689 | A | 8/1974 | Smith | |
| 5,046,271 | A * | 9/1991 | Daniels | E01H 5/068 37/231 |
| 5,520,428 | A * | 5/1996 | Bell | B60R 19/56 293/102 |
| 6,116,846 | A | 9/2000 | Bulkley | |
| 6,154,911 | A | 12/2000 | Vanderlinden | |
| 6,163,985 | A | 12/2000 | Chinnery et al. | |
| 6,640,468 | B2 | 11/2003 | Menze | |
| D594,882 | S | 6/2009 | Schultz | |
| 8,840,353 | B2 | 9/2014 | Hopkins | |

* cited by examiner

*Primary Examiner* — Stephen Gordon
(74) *Attorney, Agent, or Firm* — Kyle A. Fletcher, Esq.

(57) ABSTRACT

The front-mounted debris clearing device is a repositionable push frame mounted on the front of a vehicle that can be used to clear debris off of the travel surface of a road. The device utilizes pyrotechnic bolts at several key locations so that a portion of the device may be jettisoned if necessary for umimpeded use of the vehicle.

14 Claims, 5 Drawing Sheets

VEHICLE DEBRIS CLEARING DEVICE

CROSS REFERENCES TO RELATED APPLICATIONS

This application claims benefit of priority from U.S. Provisional Application Ser. No. 62/278,289, filed on Jan. 13, 2016, the entire contents of which are incorporated herein by reference.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of emergency responder equipment and more particularly, to a new vehicle-mounted apparatus that allows emergency vehicles to remove debris from travel surfaces.

Emergency responders, such a police officers, firefighters, and ambulance crews sometimes come upon debris that presents a risk to the general public. The debris may include animal carcasses, bags of trash, parts of vehicles, furniture, large rocks, tire treads, unsecured dunnage, and other items that may have fallen onto the road from vehicles, bridges, or the roadside. Left on the road the debris could cause an accident leading to injury or death. To prevent scenarios such as these, emergency responders will typically attempt to remove the debris from the travel surface.

SUMMARY OF INVENTION

The front-mounted debris clearing device is a repositionable push frame mounted on the front of a vehicle that can be used to clear debris off of the travel surface of a road. The device utilizes pyrotechnic bolts at several key locations so that a portion of the device may be jettisoned if necessary for unimpeded use of the vehicle.

An object of the invention is to provide a vehicle with front-mounted push frame that is useful for removing debris from a road surface.

A further object of the invention is to be able to move the push frame into an upward home position or into a downward deployed position from within the vehicle.

Yet another object of the invention is to be able to quickly jettison a portion of the front-mounted debris clearing device under circumstances where a malfunctioning mechanism would prevent an emergency vehicle that is equipped with the front-mounted debris clearing device from answering an emergency call.

These together with additional objects, features and advantages of the front-mounted debris clearing device will be readily apparent to those of ordinary skill in the art upon reading the following detailed description of the presently preferred, but nonetheless illustrative, embodiments when taken in conjunction with the accompanying drawings.

In this respect, before explaining the current embodiments of the front-mounted debris clearing device in detail, it is to be understood that the front-mounted debris clearing device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the front mounted debris clearing device.

It is therefore important that the claims be regarded as including such equivalent construction insofar as they do not depart from the spirit and scope of the front mounted debris clearing device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
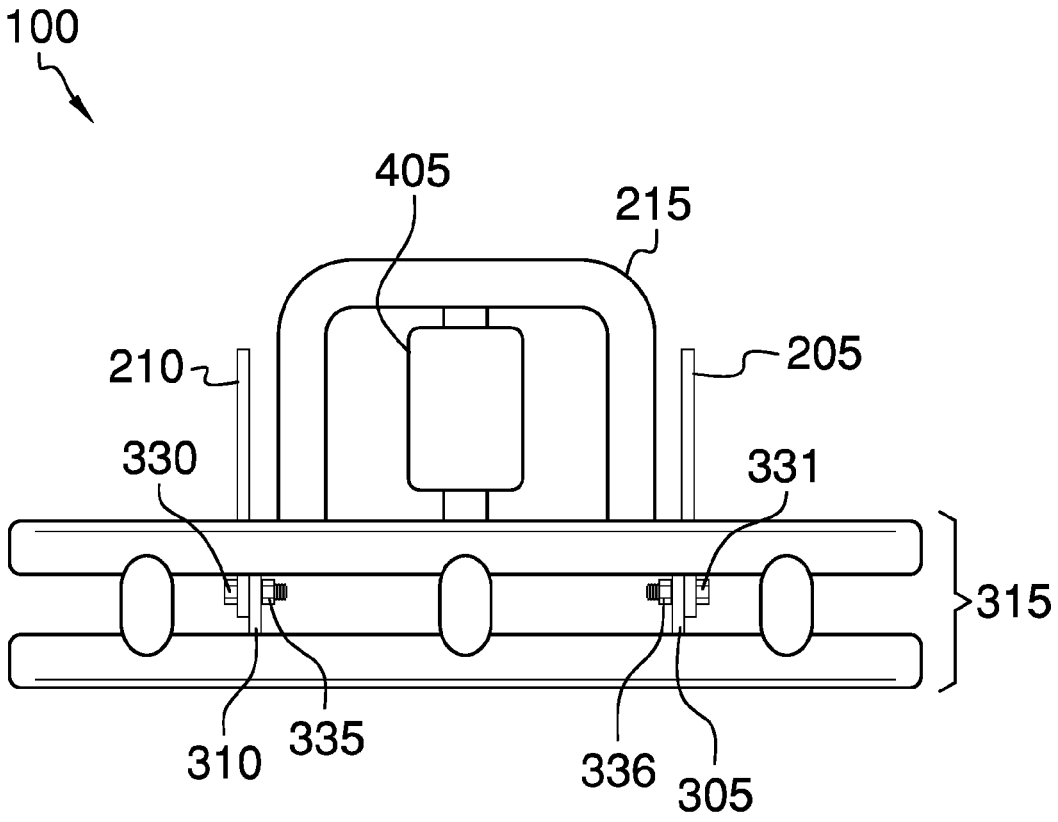
FIG. 1 is a front view of an embodiment of the disclosure while in the home position.
Figure 2:
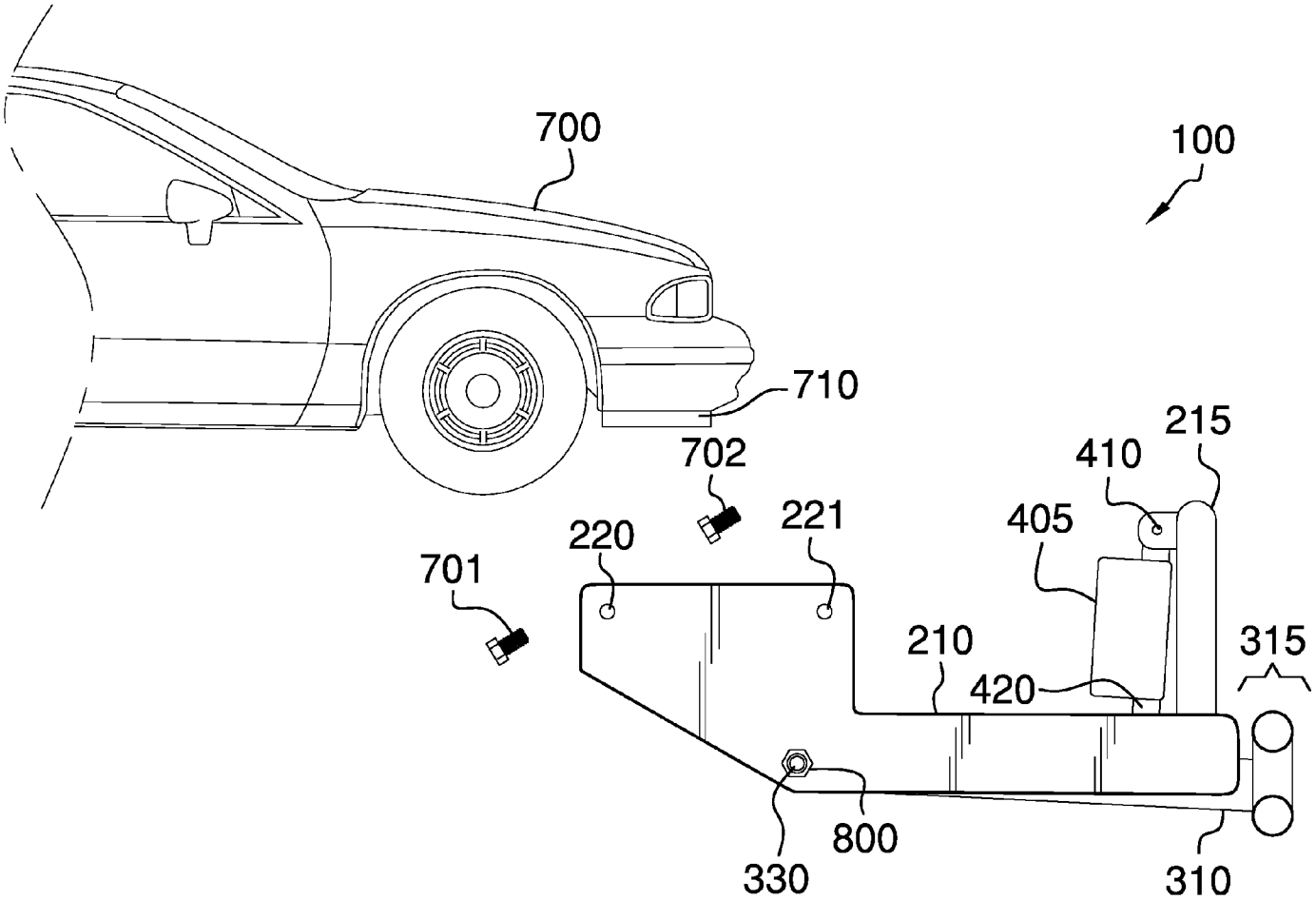
FIG. 2 is a side view of an embodiment of the disclosure while in the home position.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations.

As used herein the word "or" is intended to be inclusive. As used herein, the word "debris" is intended to include any form of hazardous or potential hazardous material or object produced by vehicular or non-vehicular sources, which is located on or near the travel surface of a road and which is foreign to a normal road surface. As used herein, the word "control" is intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

Throughout this document reference to the usage of a bolt includes the usage of one or more nuts, flat washers, star washers, cotter pins, or other hardware ordinarily associated with the use of a bolt and appropriate for the embodiment whether explicitly stated or not. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 6. The front-mounted debris clearing device 100 (hereinafter invention) comprises a mounting subassembly 200, a pushing subassembly 300, an actuator subassembly 400, and an operator interface 600.

The mounting subassembly 200 comprises a left mounting arm 205, a right mounting arm 210, and an actuator arch 215. The right mounting arm 210 fastens to a vehicle 700 using a first mounting bolt 701 and a second mounting bolt 702. The first mounting bolt passes through a first mounting hole 220 located near the upper rear portion of the right mounting arm 210 and a corresponding hole in a vehicle chassis 710. The second mounting bolt 702 passes through a second mounting hole 221 located near the upper center portion of the right mounting arm 210 and a corresponding hole in the vehicle chassis 710. The left mounting arm 205 fastens to the vehicle 700 using a third mounting bolt (not depicted) and a fourth mounting bolt (not depicted). It shall be noted that the third mounting bolt and the fourth mounting bolt are duplicates of the first mounting bolt 701 and the second mounting bolt 702, respectively. The third mounting bolt passes through a third mounting hole 266 located near the upper rear portion of the left mounting arm 205 and a corresponding hole in the vehicle chassis 710. The fourth mounting bolt passes through a fourth mounting hole 267 located near the upper center portion of the left mounting arm 205 and a corresponding hole in the vehicle chassis 710. When installed on the vehicle 700, the left mounting arm 205 and the right mounting arm 210 lie substantially parallel to each other. In some embodiments the left mounting arm 205 and the right mounting arm 210 might be welded to the vehicle chassis 710 instead of bolted.

A first mount pivot hole 800 is located on the lower rear portion of the right mounting arm 210. A first pyrotechnic pivot bolt 330 passing through the first mount pivot hole 800 serves as one of the pivot points for the pushing subassembly 300 which will be described later. A second mount pivot hole 801 is located on the lower rear portion of the left mounting arm 205. A second pyrotechnic pivot bolt 331 passing through the second mount pivot hole 801 serves as one of the pivot points for the pushing subassembly 300, which will be described later. It shall be noted that the second mount pivot hole 801 is a mirror of the first mount pivot hole 800.

The actuator arch 215 connects between the front of the left mounting arm 205 and the front of the right mounting arm 210. The purposes of the actuator arch 215 is to help to maintain the spacing between the left mounting arm 205 and the right mounting arm 210 and to provide a high, central mounting point for the top end of the actuator subassembly 400.

The pushing subassembly 300 comprises a left deployment arm 305, a right deployment arm 310, a push frame 315, and an actuator crossbar 320. The left deployment arm 305 and the right deployment arm 310 lie substantially parallel to each other. A first deployment pivot hole 366 is located near the rear of the right deployment arm 310. A first pyrotechnic pivot bolt 330 passing through the first deployment pivot hole 366 serves as one of the pivot points for the pushing subassembly 300. A second deployment pivot hole 367 is located near the rear of the left deployment arm 305. A second pyrotechnic pivot bolt 331 passing through the second deployment pivot hole 367 serves as one of the pivot points for the pushing subassembly 300.

The push frame 315 connects to the front of the left deployment arm 305 and to the front of the right deployment arm 310. The actuator crossbar 320 connects between the left deployment arm 305 and the right deployment arm 310 near the front of the left deployment arm 305 and right deployment arm 310, but far enough towards the rear of the pushing subassembly 300 to act as a mounting point for the bottome end of the actuator subassembly 400. In some embodiments the actuator crossbar 320 may be located far enough back in the pushing subassembly 300 that when the mounting subassembly 200 and the pushing subassembly 300 are connected using the first pyrotechnic pivot bolt 330 and the second pyrotechnic pivot bolt 331, the actuator crossbar 320 on the pushing subassembly 300 will be located just to the rear of the actuator arch 215 on the mounting subassembly 200.

The purpose of the push frame 315 may include providing a large, sturdy surface for pushing debris from the road surface. In some embodiments the push frame 315 may comprise two or more horizontal, straight members interconnected by two or more short, vertical members where the horizontal and vertical members are constructed from tubular steel.

The pushing subassembly 300 is installed into the mounting subassembly 200 such that the left deployment arm 305 and the right deployment arm 310 are located between the left mounting arm 205 and the right mounting arm 210 with the left deployment arm 305 adjacent to the left mounting arm 205, and the right deployment arm 310 adjacent to the right mounting arm 210.

The right deployment arm 310 attaches to the right mounting arm 210 using a first pyrotechnic pivot bolt 330 and a first nut for a pyrotechnic pivot bolt 335. The right deployment arm 310 may pivot with respect to the right mounting arm 210 around the first pyrotechnic pivot bolt 330.

The left deployment arm 305 attaches to the left mounting arm 205 using a second pyrotechnic pivot bolt 331 and a second nut for a pyrotechnic pivot bolt 336. The left deployment arm 305 may pivot with respect to the left mounting arm 205 around the second pyrotechnic pivot bolt 331.

Figure 3:
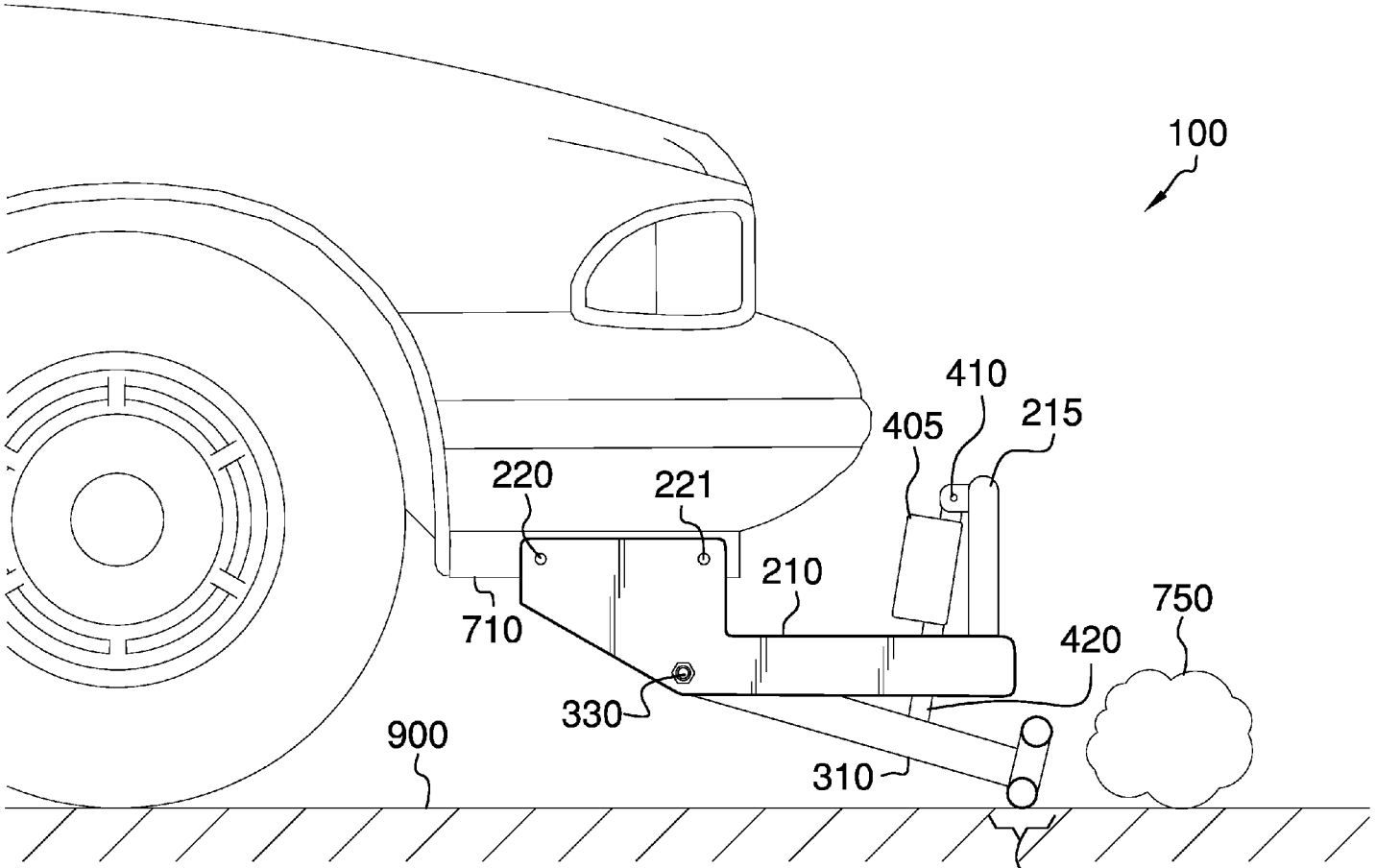
FIG. 3 is a side view of an embodiment of the disclosure while in the deployed position.
Figure 4:
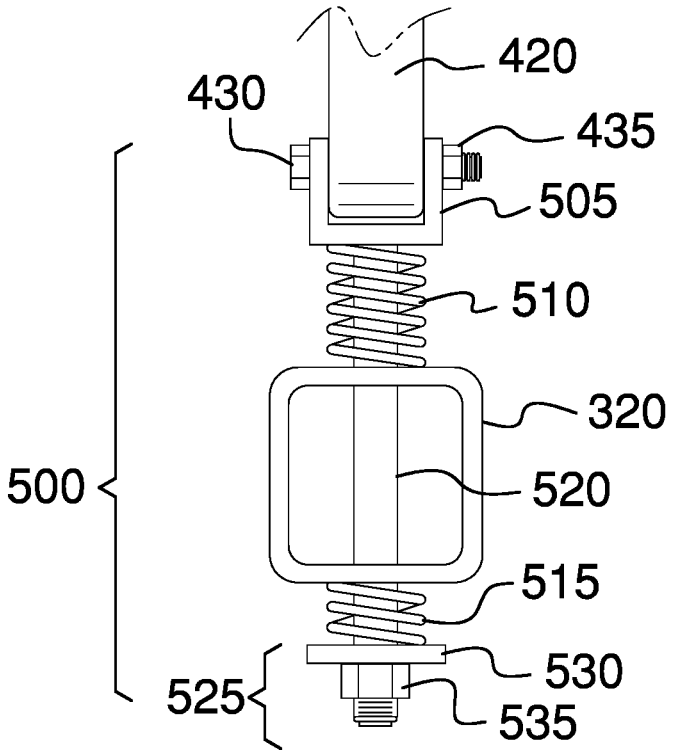
FIG. 4 is a side view of a deviation subassembly consistent with an embodiment of the disclosure.
Figure 5:
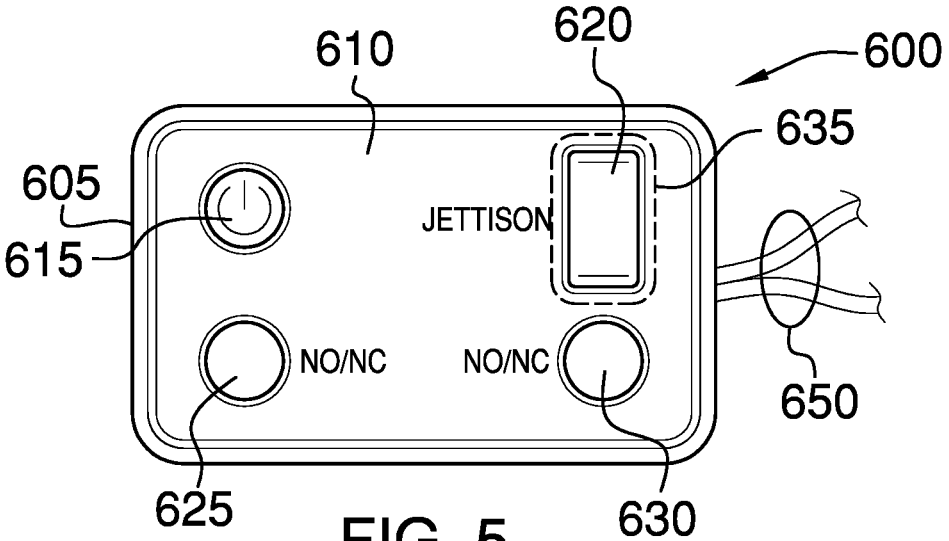
FIG. 5 is a top view of an operator interface consistent with an embodiment of the disclosure.
Figure 6:
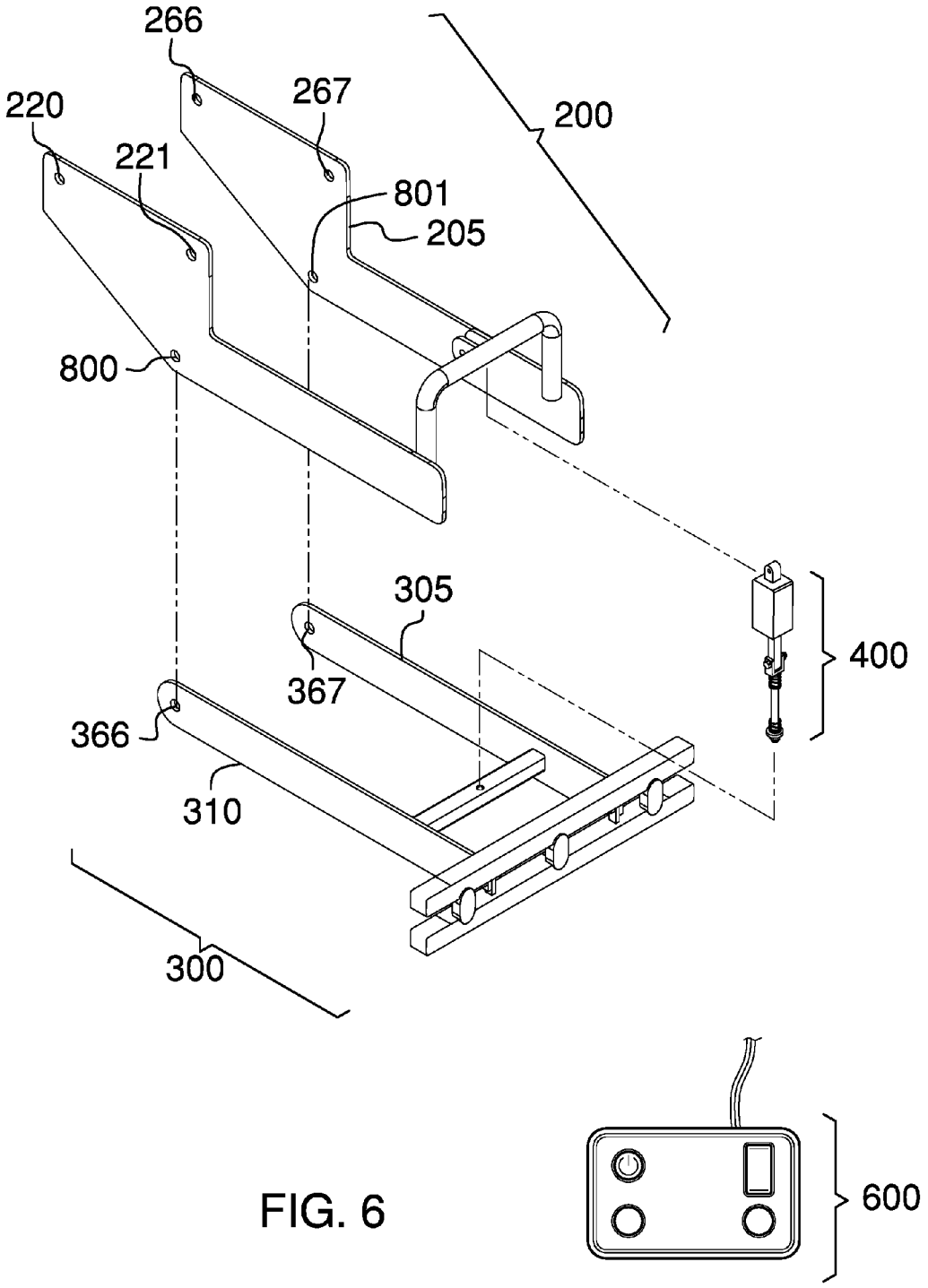
FIG. 6 is an exploded view of an embodiment of the disclosure.

The first pyrotechnic pivot bolt 330 and the second pyrotechnic pivot bolt 331 locate on the sides of the front-mounted debris clearing device 100 allow the pushing subassembly 300 to pivot within the mounting subassembly 200 and this pivoting action allows the distance between the pushing frame 315 to move between an upward home position (see FIG. 2) and a downward deployed position (see FIG. 3). In the downward deployed position the push frame 315 may touch a ground surface 900.

The purpose of the actuator subassembly 400 may include lowering the push frame 315 towards the ground surface 900 by expanding itself between the actuator arch 215 on the mounting subassembly 200 and the actuator crossbar 320 on the pushing subassembly 300. Since the actuator arch 215 on the mounting subassembly 200 is in a fixed position relative to the vehicle 700 and the ground surface 900, expansion of the actuator subassembly 400 causes the pushing subassembly 300 to pivot at the first pyrotechnic pivot bolt 330 and at the second pyrotechnic pivot bolt 331, which results in the push frame 315 moving down towards the ground surface 900. The reverse may also be true—the actuator subassembly 400 may cause the push frame 315 to lift off of the ground surface 900 by contracting. Contraction of the actuator subassembly 400 reduces the distance between the actuator arch 215 on the mounting subassembly 200 and the actuator crossbar 320 on the pushing subassembly 300. Since the actuator arch 215 on the mounting subassembly 200 may be in a fixed position relative to the vehicle 700 and the ground surface 900, contraction of the actuator subassembly 400 causes the pushing subassembly 300 to pivot around the first pyrotechnic pivot bolt 330 and second pyrotechnic pivot bolt 331, which results in the push frame 315 moving up away from the ground.

The actuator subassembly 400 comprises a linear actuator 405, a top mounting point 410 for the linear actuator 405, a bottom mounting point 415 for the linear actuator 405, and a deviation subassembly 500. The linear actuator 405 may be a device that converts an electrical energy into mechanical motion—specifically linear motion of a shaft. A number of different types of linear actuators are available but for the purposes of this disclosure all that may be important is that the linear actuator 405 comprises the top mounting point 410, a movable shaft 420, the bottom mounting point 415, and an actuator electrical connection 425 such as a cable. The top mounting point 410 of the linear actuator 405 connects to the center of the actuator arch 215 on the mounting subassembly 200. The bottom mounting point 415 of the linear actuator 405 connects to the deviation subassembly 500. The bottom mounting point 415 of the linear actuator 405 connects to the bottom end of a movable shaft 420.

The purpose of the deviation subassembly 500 may be to provide leeway in the up and down motion of the pushing subassembly 300 when the invention 100 is deployed and in use. As a non-limiting example, if the push frame 315 is in the deployed position such that the bottom of the push frame 315 is against the ground surface 900, and the vehicle 700 starts moving it is possible there may be an upward pressure applied to the bottom of the push frame 315 due to an uneven ground surface 900, railroad tracks, the edge of a pot hole, or other road surface anomalies.

If some mechanism for compensating for this upward pressure is not provided, then the force of the upward pressure may be communicated to the linear actuator 405 or some other part of the invention 100 or to the vehicle 700 that the invention 100 is mounted on resulting in damage. The deviation subassembly 500 provides this relief mechanism by proving a compression spring on each side of the connection between the actuator subassembly 400 and the actuator crossbar 320 on the pushing subassembly 300.

The deviation subassembly 500 comprises a mounting bracket 505, a guide rod 520, a top compression spring 510, a bottom compression spring 515, and a bottom retention mechanism 525. The mounting bracket 505 of the deviation subassembly 500 may be attached to bottom mounting point of the linear actuator 405 via a pyrotechnic actuator bolt 430 and nut for the pyrotechnic actuator bolt 435. The guide rod 520 connected to the mounting bracket 505 runs through the top compression spring 510, through the actuator crossbar 320 on the pushing subassembly 300, through the bottom compression spring 515, and terminates with the bottom retention mechanism 525 to hold the deviation subassembly 500 together. In a certain embodiments, the guide rod 520 may be threaded and the bottom retention mechanism 525 may comprise a retention washer 530 and a retention nut 535.

The linear actuator 405 may be configured to feed the movable shaft 420 out of the bottom of the linear actuator 405 or to pull the movable shaft 420 into the linear actuator 405 based upon the presence and polarity of an electrical signal applied to the electrical connection to the linear actuator 405.

In some embodiments, the left mounting arm 205, the right mounting arm 210, the left deployment arm 305, and the right deployment arm 310 may be constructed from sheet steel and the actuator arch 215 and the push frame 315 members may be constructed from tubular steel. In certain embodiments, the actuator crossbar 320 may be constructed from heavy wall square steel tubing.

The operator interface 600 comprises a control box 605 with a control electrical connection 650. The control box 605 may be mounted inside of the vehicle and the control box 605 may comprise a control panel 610. The control panel may provide access to a push frame deploy control 615, a jettison enable control 620, a first jettison activation control 625, and a second jettison activation control 630. The push frame deploy control 615 may be a momentary contact control, which, when activated, causes electrical energy from the vehicle electrical system to be applied to the linear actuator 405 by way of the control electrical connection 650 and thereby causing the actuator subassembly 400 to expand and force the pushing subassembly 300 to pivot in a direction, which brings the push frame 315 into contact with the ground surface 900. The push frame 315 may remain in contact with the ground surface 900 for only as long as the push frame deploy control 615 is activated. If the operator deactivates the push frame deploy control 615, then the control box 605 sends an appropriate signal to the linear actuator 405 to cause the linear actuator 405 to contract and thereby pivot the pushing subassembly 300 back to its home position where the push frame 315 is no longer in contact with the ground surface 900.

In some embodiments, the control panel 610 may provide a separate power on/off control (not shown in the figures) and the power on/off control may need to be set to the 'on' position in order for any portion of the front-mounted debris clearing device 100 to function.

The jettison enable control 620 may be located under a protective cover 635 to prevent accidental activation. A non-limiting example of a protective cover may be a hinged, clear plastic shield which prevents contact with the jettison enable control 620 and which may be lifted to expose the jettison enable control 620. When the jettison enable control 620 has been activated, an electrical signal may be applied to the first jettison activation control 625. The first jettison activation control 625 and the second jettison activation control 630 may be electrically wired to form a series circuit capable of energizing the pyrotechnic pivot bolts 330 and the pyrotechnic actuator bolt 430.

If the jettison enable control 620 is activated, then simultaneous activation of the first jettison activation control 625 and the second jettison activation control 630 may allow electrical energy to flow to the pyrotechnic pivot bolts 330 and the pyrotechnic actuator bolt 430. This may result in the detonation of a small explosive charge contained within the pyrotechnic pivot bolts 330 and the pyrotechnic actuator bolt 430. Detonation of the charge within a pyrotechnic bolt causes the bolt to bring into two or more pieces. The pushing subassembly 300 connects to the mounting subassembly 200 at only three points—the two pivot points and at the actuator.

Breaking the two pyrotechnic pivot bolts 330 and the pyrotechnic actuator bolt 430 may cause a complete separation between the pushing subassembly 300 and the rest of the vehicle. In the event that an electrical or mechanical failure of the front-mounted debris clearing device 100 causes the push frame 315 to be stuck in the deployed position and it is necessary for the vehicle to respond to an emergency call, the operator of the vehicle may use this mechanism to jettison the pushing subassembly 300 so that the vehicle can back away from it and proceed to the emergency call.

In some embodiments the pyrotechnic actuator bolt 430 is located at the lower end of the actuator subassembly 400 where it joins the pushing subassembly 300 so that linear actuator 405 and the deviation subassembly 500 are retained with the vehicle 700 after an emergency jettison of the pushing subassembly 300.

In some embodiments the control box electrical connection 650 may be protected by thermal overload breakers.

In operation, the operator of the invention 100 would position their vehicle 700 so that debris 750 to be removed is in front of the vehicle 700. They would then activate the push frame deploy control 615 causing the pushing subassembly 300 to pivot downward into a deployed position and bringing the push frame 315 into contact with the ground surface 900. While holding the push frame deploy control 615 in the activated position, the operator would then maneuver their vehicle 700 to push the debris 750 off of the travel surface of the ground surface 900. The operator would then deactivate the push frame deploy control 615, causing the pushing subassembly 300 to pivot upwards to its home position and raising the push frame 315 away from the ground surface 900.

If for some reason the push frame 315 gets stuck in the downward position and the vehicle 700 must respond to an emergency call, the operator may open the protective cover 635 over the jettison enable control 620, activate the jettison enable control 620, and simultaneously activate the first activation control 630 and the second activation control 625. This sequence will cause the pyrotechnic pivot bolts 330 and the pyrotechnic actuator bolt 430 to break thus releasing the pushing subassembly 300 from the mounting subassembly 200. The operator may then back the vehicle 700 away from the detached pushing subassembly and proceed to the emergency call.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A vehicle debris clearing device comprising:

a mounting subassembly that is configured to be affixed to a vehicle chassis of a vehicle;

a pushing subassembly is in pivotable arrangement with the mounting subassembly;

an actuator subassembly is able to pivot the pushing subassembly with respect to the mounting subassembly;

an operator interface provides for control over the vehicle debris clearing device;

wherein the pushing subassembly is adapted to interface with debris in order to remove said debris from a ground surface;

wherein the mounting subassembly comprises a left mounting arm, a right mounting arm, and an actuator arch;

wherein the right mounting arm is configured to fasten to the vehicle using a first mounting bolt and a second mounting bolt;

wherein the first mounting bolt passes through a first mounting hole located adjacent an upper rear portion of the right mounting arm and a corresponding hole in the vehicle chassis;

wherein the second mounting bolt passes through a second mounting hole located adjacent an upper center portion of the right mounting arm and a corresponding hole in the vehicle chassis;

wherein the left mounting arm fastens to the vehicle using a third mounting bolt and a fourth mounting bolt;

wherein the third mounting bolt and the fourth mounting bolt are duplicates of the first mounting bolt and the second mounting bolt, respectively;

wherein the third mounting bolt passes through a third mounting hole located adjacent an upper rear portion of the left mounting arm and a corresponding hole in the vehicle chassis;

wherein the fourth mounting bolt passes through a fourth mounting hole located adjacent an upper center portion of the left mounting arm and a corresponding hole in the vehicle chassis;

wherein when installed on the vehicle, the left mounting arm and the right mounting arm lie substantially parallel to each other;

wherein a first mount pivot hole is located on a lower rear portion of the right mounting arm;

wherein a first pyrotechnic pivot bolt passing through the first mount pivot hole serves as one of a plurality of pivot points for the pushing subassembly.

2. The vehicle debris clearing device according to claim 1 wherein a second mount pivot hole is located on a lower rear portion of the left mounting arm; wherein a second pyrotechnic pivot bolt passing through the second mount pivot hole serves as one of the plurality of pivot points for the pushing subassembly; wherein the second mount pivot hole is a mirror image of the first mount pivot hole.

3. The vehicle debris clearing device according to claim 2 wherein the actuator arch connects between a front of the left mounting arm and a front of the right mounting arm; wherein the actuator arch maintains a spacing between the left mounting arm and the right mounting arm.

4. The vehicle debris clearing device according to claim 3 wherein the pushing subassembly comprises a left deployment arm, a right deployment arm, a push frame, and an actuator crossbar;

wherein the left deployment arm and the right deployment arm lie substantially parallel to each other.

5. The vehicle debris clearing device according to claim 4 wherein a first deployment pivot hole is located near a rear of the right deployment arm; wherein a first pyrotechnic pivot bolt passing through the first deployment pivot hole serves as one of the plurality of pivot points for the pushing subassembly; wherein a second deployment pivot hole is located near a rear of the left deployment arm; wherein the second pyrotechnic pivot bolt passing through the second deployment pivot hole serves as one of the plurality of pivot points for the pushing subassembly.

6. The vehicle debris clearing device according to claim 5 wherein the push frame connects to a front of the left deployment arm and to a front of the right deployment arm; wherein the actuator crossbar connects between the left deployment arm and the right deployment arm near the front of the left deployment arm and right deployment arm.

7. The vehicle debris clearing device according to claim 6 wherein the pushing subassembly is installed into the mounting subassembly such that the left deployment arm and the right deployment arm are located between the left mounting arm and the right mounting arm with the left deployment arm adjacent to the left mounting arm, and the right deployment arm adjacent to the right mounting arm; wherein the right deployment arm attaches to the right mounting arm using the first pyrotechnic pivot bolt; wherein the right deployment arm pivots with respect to the right mounting arm around the first pyrotechnic pivot bolt; wherein the left deployment arm attaches to the left mounting arm using the second pyrotechnic pivot bolt; wherein the left deployment arm pivots with respect to the left mounting arm around the second pyrotechnic pivot bolt.

8. The vehicle debris clearing device according to claim 7 wherein the first pyrotechnic pivot bolt and the second pyrotechnic pivot bolt are each located on sides of the vehicle debris clearing device to allow the pushing subassembly to pivot within the mounting subassembly such that the pushing frame moves between an upward home position and a downward deployed position; wherein the downward deployed position enables the push frame to be adapted to touch the ground surface.

9. The vehicle debris clearing device according to claim 8 wherein the actuator subassembly lowers the push frame towards the ground surface by expanding the actuator subassembly between the actuator arch on the mounting subassembly and the actuator crossbar on the pushing subassembly; wherein the actuator arch on the mounting subassembly is in a fixed position relative to the vehicle and the ground surface, expansion of the actuator subassembly causes the pushing subassembly to pivot at the first pyrotechnic pivot bolt and at the second pyrotechnic pivot bolt, which results in the push frame moving down towards the ground surface.

10. The vehicle debris clearing device according to claim 9 wherein the actuator subassembly comprises a linear actuator, a top mounting point for the linear actuator, a bottom mounting point for the linear actuator, and a deviation subassembly; wherein the linear actuator comprises the top mounting point, a movable shaft, the bottom mounting point, and an actuator electrical connection; wherein the top mounting point of the linear actuator connects to the center of the actuator arch on the mounting subassembly; wherein the bottom mounting point of the linear actuator connects to the deviation subassembly; wherein the bottom mounting point of the linear actuator connects to a bottom end of a movable shaft.

11. The vehicle debris clearing device according to claim 10 wherein the deviation subassembly comprises a mounting bracket, a guide rod, a top compression spring, a bottom compression spring, and a bottom retention mechanism; wherein the mounting bracket of the deviation subassembly is attached to bottom mounting point of the linear actuator via a pyrotechnic actuator bolt and nut; wherein the guide rod runs through the top compression spring, through the actuator crossbar on the pushing subassembly, through the bottom compression spring, and terminates with the bottom retention mechanism to hold the deviation subassembly together; wherein the guide rod is threaded and the bottom retention mechanism includes a retention washer and a retention nut.

12. The vehicle debris clearing device according to claim 11 wherein the linear actuator feeds or pulls the movable shaft out of the bottom of the linear actuator upon the presence and polarity of an electrical signal applied to the electrical connection to the linear actuator.

13. The vehicle debris clearing device according to claim 12 wherein the operator interface comprises a control box with a control electrical connection; wherein the control box is adapted to be mounted to the vehicle and includes a control panel;

wherein the control panel provides access to a push frame deploy control, a jettison enable control, a first jettison activation control, and a second jettison activation control; wherein the push frame deploy control is a momentary contact control, which, when activated, causes electrical energy from the vehicle electrical system to be applied to the linear actuator via the control electrical connection and thereby causing the actuator subassembly to expand and force the pushing subassembly to pivot in a direction, which brings the push frame into contact with the ground surface; wherein the push frame remains in contact with the ground surface for only as long as the push frame deploy control is activated.

14. The vehicle debris clearing device according to claim 13 wherein upon activation of the jettison enable control, simultaneous activation of the first jettison activation control and the second jettison activation control allows electrical energy to flow to the first pyrotechnic pivot bolt, the second pyrotechnic pivot bolt, and the pyrotechnic actuator bolt, which results in the detonation of a small explosive charge contained within the first pyrotechnic pivot bolt, the second pyrotechnic pivot bolt, and the pyrotechnic actuator bolt; wherein detonation of the charge results in two or more pieces; wherein breaking the first pyrotechnic pivot bolt as well as the second pyrotechnic pivot bolt and the pyrotechnic actuator bolt results in a complete separation between the pushing subassembly and the vehicle.

* * * * *